US010718175B2

(12) United States Patent
Cabot et al.

(10) Patent No.: US 10,718,175 B2
(45) Date of Patent: Jul. 21, 2020

(54) LIGHT AND BUOYANT RETRIEVABLE ASSEMBLY—WELLBORE TOOL AND METHOD

(71) Applicant: NAUTONNIER HOLDING CORP., Cochrane (CA)

(72) Inventors: Bernie Cabot, Cochrane (CA); David Cramer, Okotoks (CA)

(73) Assignee: NAUTONNIER HOLDING CORP, Cochrane (CA)

( * ) Notice: Subject to any disclaimer, the term of this patent is extended or adjusted under 35 U.S.C. 154(b) by 0 days.

(21) Appl. No.: 16/208,305

(22) Filed: Dec. 3, 2018

(65) Prior Publication Data

US 2019/0169954 A1 Jun. 6, 2019

Related U.S. Application Data

(60) Provisional application No. 62/594,463, filed on Dec. 4, 2017, provisional application No. 62/649,837, filed on Mar. 29, 2018.

(51) Int. Cl.

| | |
|---|---|
| ***E21B 27/02*** | (2006.01) |
| ***E21B 23/04*** | (2006.01) |
| ***E21B 23/08*** | (2006.01) |
| *E21B 33/127* | (2006.01) |
| *E21B 33/12* | (2006.01) |
| *E21B 23/00* | (2006.01) |
| *E21B 17/01* | (2006.01) |
| *E21B 4/04* | (2006.01) |
| *E21B 33/134* | (2006.01) |

(52) U.S. Cl.

CPC ..... *E21B 27/02* (2013.01); *E21B 23/04* (2013.01); *E21B 23/08* (2013.01); *E21B 4/04* (2013.01); *E21B 17/012* (2013.01); *E21B 33/1208* (2013.01); *E21B 33/1272* (2013.01); *E21B 33/1275* (2013.01); *E21B 33/134* (2013.01); *E21B 2023/008* (2013.01)

(58) Field of Classification Search

CPC ..... E21B 27/02; E21B 23/08

See application file for complete search history.

(56) References Cited

U.S. PATENT DOCUMENTS

| | | | | |
|---|---|---|---|---|
| 5,469,918 | A | 11/1995 | Haberman | |
| 9,790,755 | B2 | 10/2017 | Bourque | |
| 2010/0155054 | A1 | 6/2010 | Innes et al. | |
| 2016/0251941 | A1* | 9/2016 | Murphree | E21B 23/01 166/387 |

* cited by examiner

*Primary Examiner* — Kristyn A Hall

(74) *Attorney, Agent, or Firm* — Bennett Jones LLP

(57) ABSTRACT

A wellbore self-retrievable tool for conveying and releasing a load in a well, such as for wellbore abandonment, wherein the load is a resin for producing a set resin plug. The tool comprises: a floatation device; a load carrier, such as a payload tube; and a load release mechanism, the floatation device being configured to render the tool buoyant in a wellbore liquid.

11 Claims, 6 Drawing Sheets

LIGHT AND BUOYANT RETRIEVABLE ASSEMBLY—WELLBORE TOOL AND METHOD

FIELD OF INVENTION

This invention relates generally to wellbore tools for conveying a load into a well.

BACKGROUND

Wellbore operations sometimes require the conveyance of a load into the well. A load may be a structure, a tool or a liquid.

For example, without limiting the scope of the present invention, when seeking to isolate pressure between two regions in a well, sometimes a load in the form of a plug is placed in the well. These plugs are commonly placed in a subterranean well at a desired location, for example inside a casing string, to isolate pressure between two regions in the well. The plug may be an expandable structure, such as for example a bridge plug, or a liquid such as, for example, a resin such as cement or other originally flowable material.

In one approach to well abandonment, for example, a plug is formed of a bridge plug and a resin. In certain installations, this may be accomplished by first, installing a bridge plug at a desired location in the casing string and then lowering a dump bailing tool carrying a payload of flowable resin into the casing. Once the dump bailing tool is positioned in the desired location proximate the bridge plug, the dump bailing tool may be actuated to release the payload of resin. The bridge plug forms a platform on which the resin is deposited and supported. Together the bridge plug and resin form a pressure isolating plug(s).

Oftentimes a tethered conveyance is employed to carry the load into the well. A tethered conveyance is a string such as of endless tubing, jointed pipe or a line for example a slickline, wireline, or the like. In some instances, the use of a tethered conveyance for placement of a load may be undesirable due to the high deployment costs and time associated with having the deployment equipment such as a rig and the personnel to operate it.

SUMMARY

The invention provides a wellbore self-retrievable tool for conveying and releasing a load in a well, the tool comprising: a floatation device; a load carrier; and a load release mechanism.

In another aspect of the present invention, there is provided a method for conveying a load into a wellbore, the method comprising: launching an untethered self-retrievable tool into the wellbore, the tool carrying a load and being configured to release the load downhole and further configured to move upwardly in the wellbore away from the load by flotation; and retrieving the tool from the wellbore. The tool may comprise: a load carrier configured to carry the load, a load release mechanism for releasing the load from the load carrier and a floatation device coupled to the load carrier and the tool being configured to float relative to a liquid in the wellbore after the load is released. The method may include operating the load release mechanism to release the load at a position in the wellbore before retrieving the tool from the wellbore.

The load may be various types of payload such as a tool, for example, a bridge plug or a sensor or a volume of liquid for example an amount of resin. Since the load can vary, it will be appreciated that the load carrier may take various forms depending on the type of load to be carried. For example, the load carrier can be a liquid container or a releasable connector.

The load release mechanism may also take various forms depending on the type of actuation, the operation of the load carrier, etc. The load release mechanism may be automatic, responding to a condition in the wellbore or it may be controlled from surface. The load release mechanism may be mechanical, electrical, hydraulic or computer controlled.

The wellbore self-retrievable tool, being untethered, does not require a tethered conveyance or the rig and personnel to run a tethered conveyance. It can move downwardly and upwardly through the well on its own.

In one embodiment, the wellbore self-retrievable tool is a dump bailing tool such as for releasing a payload of resin into the well. In such a tool the load carrier is a container for the payload of resin such as a payload tube and the load release mechanism may be configured to release the resin from the container. A dump bailing tool therefore comprises: a floatation device; a payload container; and a payload release mechanism.

In another embodiment, the method, therefore, may be for placing a plug in the wellbore and in one embodiment may release a resin payload downhole to form a resin plug.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Accordingly, the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The self-retrievable wellbore tool and method can cost effectively deliver a load to a position in an oil and gas wellbore. The tool unloads the load and is recovered the using the buoyancy of a floatation device. Thereby the invention avoids the need for any secondary methods of retrieval, for example, using a tethered conveyance such as a line or string such as wireline, endless tubing, jointed pipe, etc.

Figure 1:
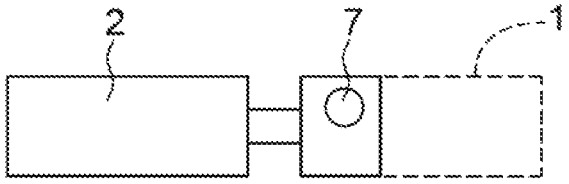
FIG. 1 is a side elevation of a light and buoyant self-retrievable wellbore tool.

One embodiment of a self-retrievable wellbore tool is illustrated in FIG. 1. The tool is configured to convey and release a load 1 in a well and is further configured to autonomously move uphole away from the load once the load is released. It may be configured to move upwardly all the way to surface. The tool includes a floatation device 2; a load carrier 4; and a load release mechanism 7.

Load 1 is shown in phantom in FIG. 1, as it is not part of the tool but is carried by the tool and deposited by the tool at a position in the well. The load may be any one or more of various things such as, for example, a tool such as a bridge plug or a sensor or a volume of liquid such as a plugging resin or various other types of payload.

Load carrier 4 may take various forms depending on the type of load to be carried. For example, load carrier 4 can be a container where the load is a liquid or includes loose materials and the container is openable to allow unloading. The load carrier for liquids is obviously configured to carry the liquid into the well. A load carrier in the form of a container for liquid resin is described more fully hereinafter.

Alternately or additionally, load carrier 4 may be a connector for releasably coupling to the load. Such a load carrier may be a solenoid, disintegrable connection or other automatically or remotely controllable releasable connector.

Load release mechanism 7 may take various forms depending on the type of load carrier and its mode of actuation, the selected trigger for load release, etc. The load release mechanism may be remotely controllable or automatic and may operate in response to a trigger such as a signal, an event or a condition occurring in the wellbore. The load release mechanism may be mechanical, electrical or computer controlled.

Load release mechanism 7 includes a component for releasing the load from the load carrier. Thus, for example, mechanism 7 for a liquid container type load carrier may include a valve, an openable closure, such as a breakable closure. For a connector-type load carrier, the load release mechanism may be a driver for releasing the connector.

In one embodiment, for example and as described hereinbelow, the load release mechanism is a mechanical structure that senses when the tool has landed against a structure in the wellbore and, after sensing the landing of the tool, the release mechanism automatically actuates the load carrier to release the load.

In another embodiment, for example, load release mechanism 7 includes a depth sensor device that is configured to determine the depth of the tool as it moves in the well. In this embodiment, the load release mechanism can be pre-set with a target depth. Load release mechanism 7 can actuate the load carrier to release the load automatically when the target depth is sensed by the depth sensor device.

There are many other options, for example, load release mechanism 7 may include a timer and may be configured to actuate the load carrier to release the load when the timer expires. Alternately or in addition, load release mechanism 7 may include a receiver and the load release mechanism may receive a signal from surface when the load is to be released.

The tool also includes flotation device 2. It is the flotation device that configures the tool for self-retrieval. In particular, wellbores often intentionally or naturally are mostly filled with a wellbore liquid such as fresh water, brine or drilling fluid. Flotation device 2 is coupled to the load carrier 4 and thereby to the load. Flotation device 2 is configured to render the tool to be buoyant in the wellbore liquid when there is no load, but is not buoyant with respect to the wellbore liquid when the load is still carried by the tool. In particular, the tool, when carrying the load, is configured to sink in the wellbore liquid such that it can move down through the wellbore, but is configured by buoyancy of the flotation device relative to the overall weight of the empty tool to be buoyant in the wellbore liquid when the tool is free of the load, such that when the load is released, the tool begins to move upwardly in the well toward surface and away from the load.

Flotation device 2 therefore is selected to float relative the type of wellbore fluid and the weight of the non-loaded tool including any components of load carrier 4 and load release mechanism 7 that remain on the tool after releasing a load. Flotation device 2, may for example be a gas filled container or have a construction of low specific gravity materials that are substantially stable in wellbore conditions, such as a metal or polymeric foam. Since most wellbore fluids are water-based, the flotation device 2 has a specific gravity of less than 1.

In operation, the self-retrievable tool is released into the wellbore while carrying a load. Downhole, according to the operation of load release mechanism 7 and the load carrier, the tool releases the load. Thereafter, the buoyancy of the empty tool causes the tool to move upwardly in the wellbore away from the released load by flotation. The tool may then be retrieved from the wellbore. In a well where the liquid column extends fully to surface, the tool can be retrieved from the wellhead.

In particular, therefore, while the loaded tool includes flotation device 2, its buoyancy is selected to be insufficient to keep the loaded tool afloat and, therefore, the loaded tool sinks in the wellbore fluid. However, once the load is released, the flotation device's buoyancy is sufficient to cause the tool to float upwardly, towards surface, in the well.

Understanding the operation of the tool, therefore, it will be understood that while the tool components may take various forms in terms of construction, size and/or operation, they must be sized to pass through the wellbore inner diameter and should be as light as possible. Also, the flotation device 2 may be at an upper end of the tool with the load to be carried therebelow. Being on the upper end, the flotation device is best positioned to float move up away from an unloaded load and to lead the tool on its ascent up the wellbore's fluid column.

The invention broadly relates to a self-retrievable tool that carries a load. In one embodiment, the tool is a dump bailing tool as described in further detail herein below. In a dump bailing tool, the load is a liquid such as a resin. The load is released in the well by flowing out of a liquid container. The tool, being buoyant, returns automatically and without intervention uphole when weight of the liquid is released from the container.

Figure 2:
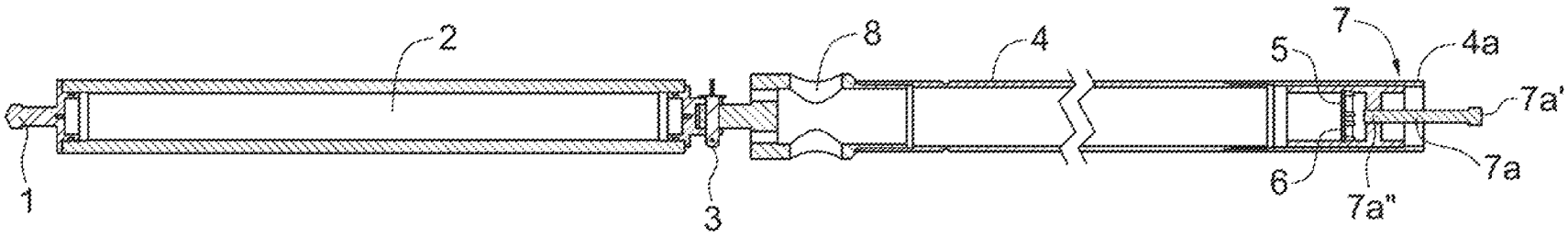
FIG. 2 is a sectional view along the length of a self-retrievable dump bailing tool.

One embodiment of a self-retrievable dump bailing tool is illustrated in FIG. 2. The tool includes a floatation device embodied as an air-filled floatation tube 2, a load carrier embodied as a tube-shaped liquid container 4 (shown empty); and a load release mechanism in the form of device 7 configured to sense when the tool has landed on a structure and configured to open the container when the tool has landed. The tool also includes, in this embodiment, a fish neck 1 on its upper end and a connector 3 between flotation tube 2 and liquid container 4. Connector 3 in this embodiment is not autonomously releasable but is readily releasable by a worker on surface to quickly connect and disconnect the flotation tube and the liquid container. Connector 3 can also have a pivotal configuration to permit bending of the tool at the connection. In one embodiment, connector 3 includes a bolt between a pair of connectable eyes.

The tool may be constructed of durable materials that are substantially stable at wellbore conditions. The materials may be selected to be light weight and in one embodiment, for example, aluminum is employed to construct much of the flotation tube and liquid container.

Flotation tube 2 is an air-filled tube. The tube is well sealed such that the air substantially cannot leak out, and therefore the tube retains its buoyancy even at downhole pressures and conditions.

Liquid container 4 is configured to contain a liquid, such as a viscous resin such as cement, and is sized to contain a sufficient volume of the liquid to overcome the buoyancy of the flotation device in the wellbore liquid in which it is to be used. The container includes sealed side walls and a bottom wall 6 that therewithin define a chamber. A liquid can be contained by the side and bottom walls and can't leak out. The container includes pressure equalizing holes 8 on its upper end.

Device 7 is configured to sense when the tool has landed on a structure and configured to open the container. To understand the nature of this device, it is noted that the present dump bailing tool is useful for placing a resin plug downhole. A resin plug is placed on a support such as a bridge plug that is positioned in the wellbore. For such an application, device 7 is positioned at the lower end of the tool and may include a mechanical trigger 7*a* that is configured as a plunger with a rod end 7*a*' protruding from an extension tube 4*a* on container 4 below wall 6. Mechanical trigger 7*a* further includes a secured end 7*a*" that is moveable with rod end 7*a*' and is slidably secured in the extension tube. Secured end 7*a*" of the trigger 7*a* is slidably moveable from a position adjacent to the end wall 6 to a position opening end wall 6. For example, end wall 6 may be constructed of a breakable or puncturable material, such as a glass disc, held in place by a metal ring 5. The trigger's secured end 7*a*" when in the second position, moves to a position to impact and open the end wall, as by breaking or puncturing it. Movement of the rod end moves the secured end, such that when the tool impacts, in other words lands, on a surface such as a bridge plug, it lands on the rod end 7*a*' that is protruding beyond tube 4*a*. The trigger, then, acts as a sensor to determine when the tool lands on a surface. The weight of the tool pushes the mechanical trigger up into extension tube 4*a* and, thereby, the secured end is moved to the second position to hit against and break open wall 6.

Figure 6A:
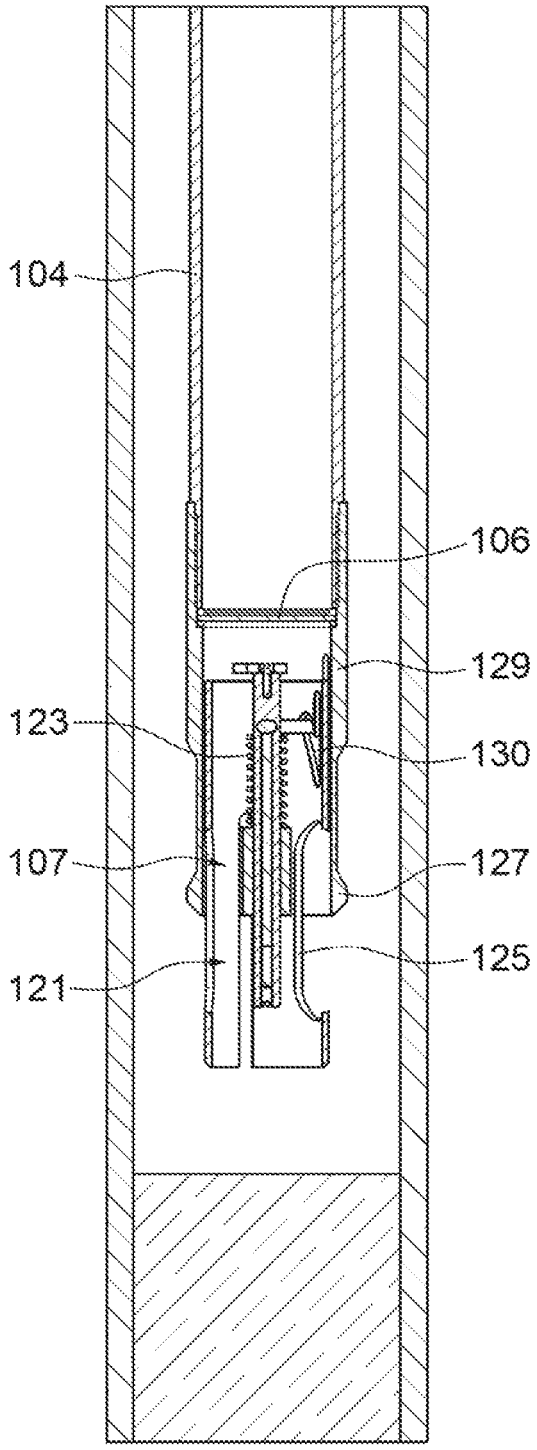
FIG. 6A is a sectional view along the long axis of a load release mechanism in the as-deployed position.

The release of the load is important, as it is the event that permits the buoyancy of the tool to return the tool towards surface. As such, a load release mechanism may have features to improve its reliability. In one embodiment, shown in FIGS. 6A and 6B for example, a load release mechanism 107 is configured to sense when the tool has landed on a structure and is configured with a force generator that ensures the plunger moves with sufficient force, when triggered, to open the container. Thus, instead of relying on the weight of the tool to drive the plunger to break open the container, the force generator applies an intentional force to ensure that the plunger is driven to break open the container.

Mechanism 107 is positioned at a lower end of a dump bailing tool container 104. Mechanism 107 includes a firing head plunger 107*a*, a sensor 121 that senses that the tool has landed and a driver, such as a spring 123, to apply force to the plunger when the sensor senses the tool as landed. Plunger 107*a* is positioned to act against glass disc 106 forming the end wall of container 104. Firing head plunger 107*a* is moveable between an initial position (FIG. 6A) and a fired position (FIG. 6B), where it has impacted against disc 106. When glass disc 106 is impacted by plunger 107*a*, the disc breaks and the load in container 104 can flow out, arrow F, and thereby be unloaded.

Figure 6B:
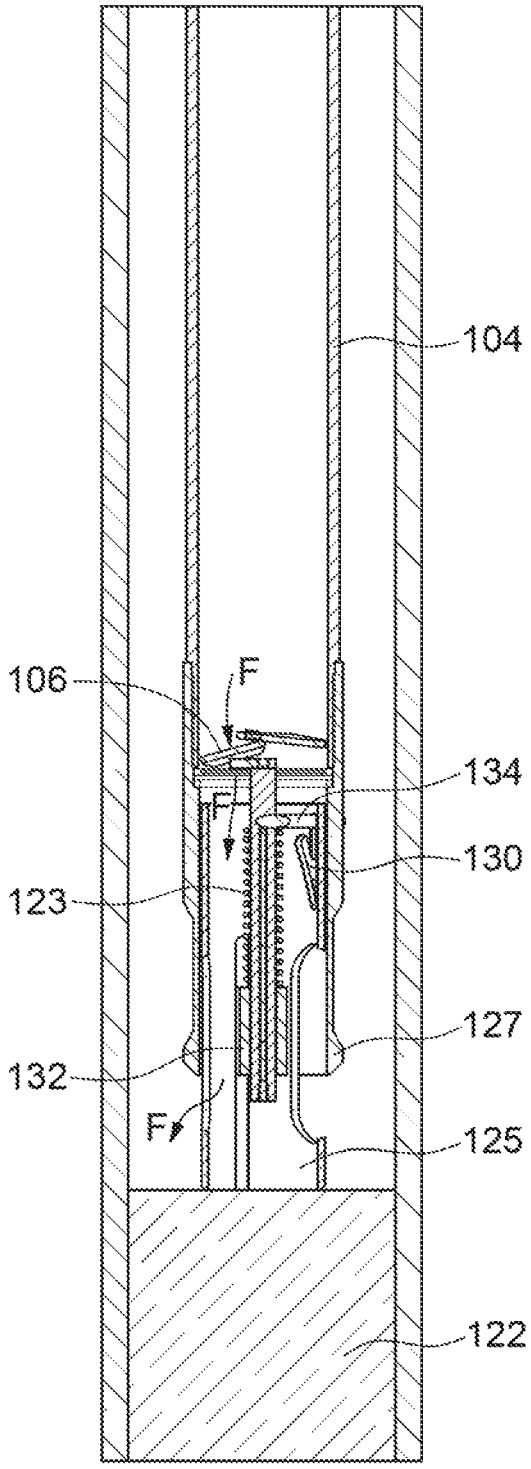
FIG. 6B is the load release mechanism of FIG. 6A in the triggered and load-release position.

The sensor 121 includes an inner strike sleeve 125 and an outer trigger sleeve 127. The outer trigger sleeve 127 is a fixed sleeve structure. Sleeve 127 supports inner sleeve 125 and includes a control slot 129 for controlling movement of plunger 107*a*. Inner strike sleeve 125 is slidably moveable within sleeve 127. Inner strike sleeve 125 is moveable from an initial, first position (FIG. 6A) to a second position (FIG. 6B). In the first position, inner strike sleeve 125 protrudes beyond outer sleeve 127 at an end of the tool. Inner strike sleeve 125 contacts with a landing surface such as bridge plug 123 and, when landed, moves into the second position which is deeper, up into outer sleeve 127. Being tubular, inner sleeve 125 is durable and readily slides axially relative to outer sleeve 127. Inner sleeve 125 may include apertures such that there can be flow between its inner diameter and outer diameter.

Inner strike sleeve 125 includes a J-type guide slot 130 that moves plunger 107*a* in response to contact with surface through control slot 129 and, thereby, releases the stored energy in spring 123 to drive firing head plunger 123 to break the glass disc. Control slot 129 and guide slot 130 are correspondingly shaped and oriented in overlapping configuration to guide and control movement of plunger 107*a*.

In particular, in this embodiment, firing head plunger 107*a* is installed in a central mount 132 but is axially moveable relative to mount 132 between its initial position (FIG. 6A) and its fired position (FIG. 6B). Central mount 132 can, for example, be coupled within outer sleeve 127. Firing head plunger 107*a* includes a guide pin 134 that passes through guide slot 130 and is secured for sliding movement along control slot 129. The control slot includes (i) a releasable lock area where guide pin 134 is initially releasably maintained to hold plunger in the first position and (ii) a firing area, in communication with the releasable lock area, where the guide pin can freely move into the second position. An upper end of the firing area of slot 129 is visible in FIG. 6A. Guide pin 134 is moved from the releasable lock area to the firing area of the slot by movement of inner sleeve from its first position to its second position and specifically from the edges of guide slot 130 pushing against guide pin 134 to move it through slot 129, in particular, from the releasable lock area to the firing area of the control slot. Control slot 129 can, for example, be L-shaped and the guide pin 134 be moved from the around the corner of the slot to enter the long vertical section of the L, which is the firing area.

Spring 123 biases plunger 107*a* into the fired position. In particular, spring 123 is compressed and stores energy when the plunger is in its initial position, but when the plunger is in the firing area of slot 129, and therefore free to move, spring 123 drives the plunger with force against to open the container. Spring can be compressed to act between mount 132 and guide pin 134. Spring can be configured to drive the firing head plunger upward with 20 to 40 lbs of force.

In this embodiment, glass disc 106 has a 2 to 6 mm thickness and is held in place by a steel ring. 105. In FIG. 6B, disc 106 is shown as shattered.

In operation, a dump bailing tool may be used for placing a liquid into a well such as a resin into an abandoned well for the resin to create a pressure-isolating seal therein. The tool is configured to be buoyant when free (i.e. empty) of a load. When loaded with resin, the dump bailing tool, due to the tool and resin weight, may overcome the buoyancy in tube 2 and descend into a liquid, such as water, filled casing until it comes into contact with a structure such as a bridge plug, already in place downhole. Upon contacting the bridge plug, triggering mechanism 7 or 107 may be activated to release the resin from container 4. Pressure equalizing holes 8 on the container's upper end avoid a pressure lock both with respect to the emptying of the container and the ability of the tool to pull upwardly away from the emptied resin. Being free of the weight of the resin, the flotation device becomes sufficiently buoyant such that the dump bailing tool including the flotation device 2, the connector 3, the now substantially emptied container 4 and secured parts of the trigger, begin to rise up in the wellbore fluid column towards surface.

Figure 3:
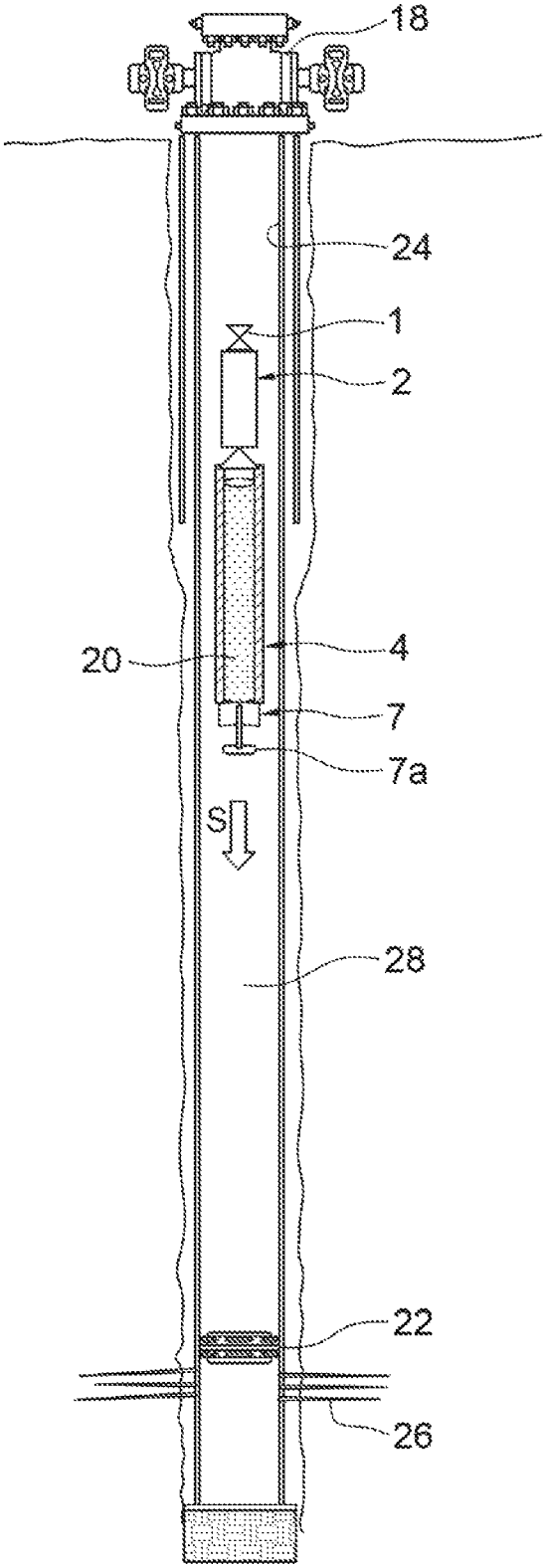
FIG. 3 shows a schematic view of an assembled and loaded tool being deployed into a well.
Figure 4:
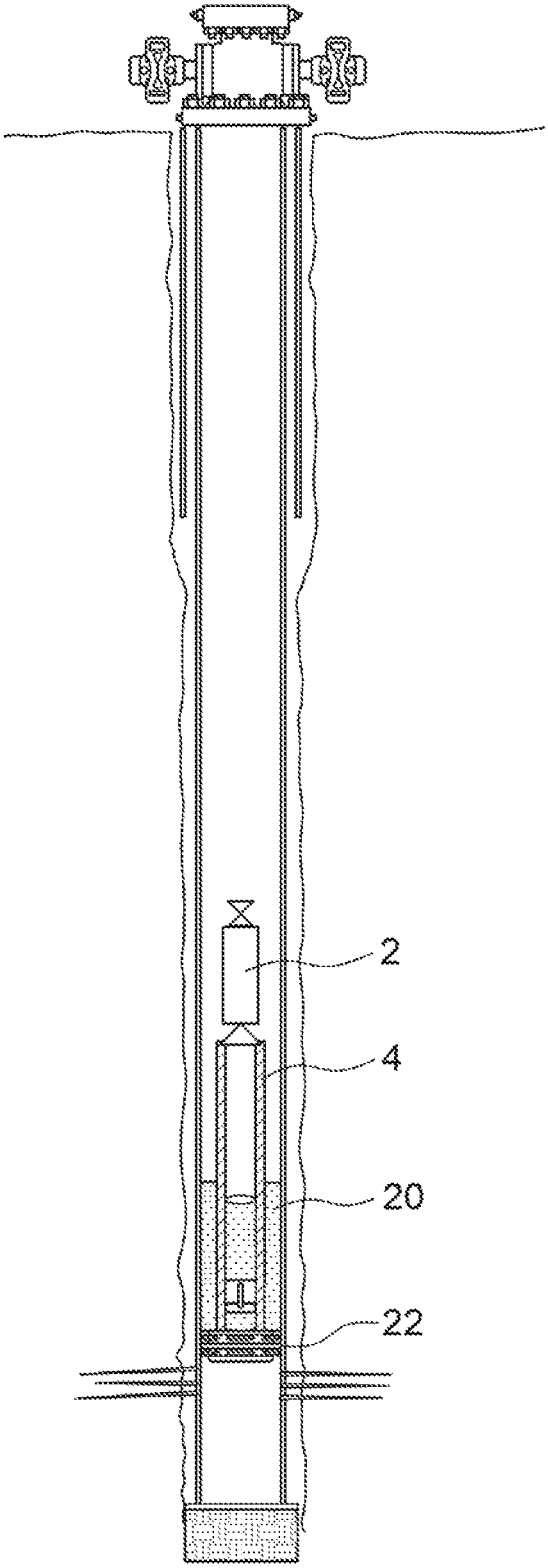
FIG. 4 shows a schematic view of the tool proximate to a bridge plug.
Figure 5:
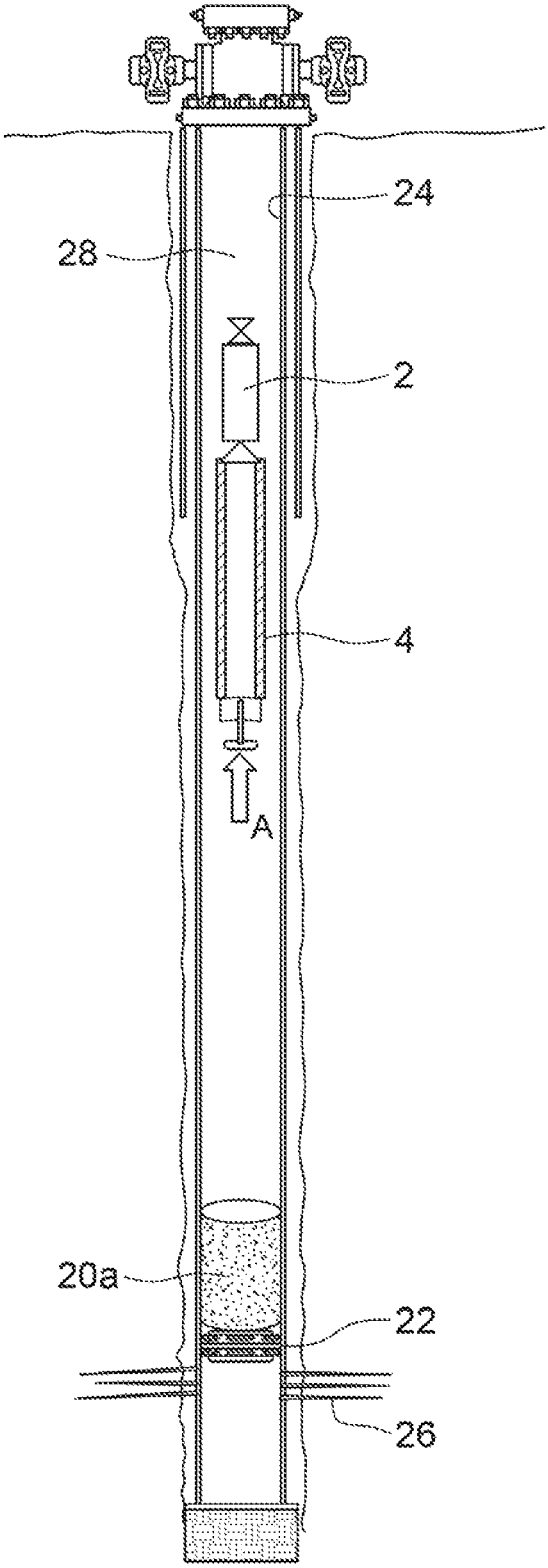
FIG. 5 shows a schematic view of the tool ascending up toward the wellhead at surface.

With reference to FIGS. 3-5, the dump bailing tool may function in the following manner in order to construct a resin plug in a well:

1. The container 4 of a dump bailing tool may be filled with resin 20 and the tool may be assembled by connecting the float tube 2 to the upper end of the container 4 via a connector 3. The amount of resin is selected to have an appropriate volume to create a resin plug in the well, such as an amount to fill a 1-3 or more meter length of the well, and to have a sufficient weight to overcome the tool's buoyancy.
2. As shown in FIG. 3, the resin-loaded tool is introduced to a well, for example at its wellhead 18. The well may have a resin plug support, such as a bridge plug 22, set therein. While the well may be open hole, or lined such as with casing, screen, etc., the illustrated well is lined with casing 24 and bridge plug 22 is positioned uphole of perforations 26.
3. The tool sinks, arrow S, in the fluid column 28 within the well. A tool may descend at 40-50 metres per minute. The tool descends to the depth of the bridge plug within the wellbore.
4. As shown in FIG. 4, once the tool reaches the bridge plug, it releases the resin from the container. If a mechanical trigger 7 as described above is employed, once rod end 7*a*' contacts the bridge plug, the downward momentum of the tool moves the secured end 7*a*" to break a glass disk that forms end wall 6, causing the resin payload to unload. The trigger may take other forms such as is described with respect to FIGS. 6A and 6B or other mechanical, hydraulic, electrical or computerized mechanisms. Once opened, resin 20 flows out of container 4 and u-tubes in the well around the bottom of the container, which means the resin flows out of the container onto the bridge plug and up between the casing 24 and outer surface of the payload tube 4. A resin for wellbore abandonment may have a weight of 1000-2000 kg/m$^3$, for example 1250-1750 kg/m$^3$. Once released in the well, the resin stays in place and sets to form a pressure-isolating plug 20*a* above the bridge plug.
5. The tool becomes buoyant after releasing at least some of the payload and begins to rise upwardly in the well. As the resin drains, the tool slowly rises over a period of less than 10 minutes, such as 2-3 minutes. The buoyancy pulls the load-free tool upwardly 2-5 metres until the tool is completely free of the resin.
6. As shown in FIG. 5, once the tool is free of its load, in this case its resin load, it begins to ascend quickly and autonomously, arrow A, toward surface at 15-30 or 20-25 metres per minute.
7. Once at the surface of the well's liquid column, herein shown at the wellhead 18, the tool floats and can be manually recovered.
8. In a wellbore abandonment operation, the resin then sets to pressure-isolate the well above and below the resin plug 20*a*.

Because the tool is untethered and moves down and up in the well by its own configuration, tool operations require only personnel to assemble and load the tool, launch it and remove the load-free tool from the well. If the tool is used for the same operation repeatedly, it will be known how much to load and what tool configuration is sufficient to sink when carrying a particular load. Thus, the loading and assembly operation can be completed very quickly, such as in less than 30 minutes. Then, after the tool is launched in the well, it works automatically, unless a signalling operation is required. In the embodiment of FIG. 2, for example, after placing the tool into the well, no intervention by personnel is required and, thus, the personnel can leave the well and move to service other wells. When the tool's operation is complete, it will be floating on the upper surface of the wellbore's fluid column and the personnel, when desired, can retrieve the tool from the well. In most wellbores, the tool will be readily retrieved through wellhead 18.

If the tool becomes stuck in the well, a fishing operation can be conducted to engage fishing neck 1 and pull the tool from the well.

While various embodiments of the invention have been described, it is to be understood that embodiments are interchangeable and features can be combined in various combinations.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A wellbore self-retrievable tool for conveying and releasing a load of a liquid in a well, the tool being configured as a dump bailing tool and comprising: a floatation device; a payload tube; and a load release mechanism, the floatation device being configured to render the tool buoyant in a wellbore liquid.

2. The tool of claim 1, wherein the payload tube is a liquid container.

3. The tool of claim 1, wherein the load release mechanism operates automatically in response to a trigger.

4. The tool of claim 1, wherein the tool is untethered, and configured to move autonomously downwardly in a well when carrying the load and upwardly through the well when free of the load.

5. The tool of claim 1, wherein the floatation device is attached to an upper end of the payload tube.

6. The tool of claim 1, wherein the load release mechanism includes a mechanical trigger for breaking a glass disk in a wall of the payload tube in response to landing on a structure in the wellbore.

7. The tool of claim 6, wherein the mechanical trigger includes a driver with stored energy for applying additional force to break the glass disk.

8. A method for abandonment of a wellbore, the method comprising: launching an untethered self-retrievable tool into the wellbore, the tool carrying a load of a resin for producing a set resin plug and being configured to release the load downhole and further configured to move upwardly in the wellbore away from the load by flotation; and retrieving the tool from the wellbore, for wellbore abandonment, wherein the load is a resin for producing a set resin plug.

9. The method of claim 8, wherein the tool comprises: a load carrier configured to carry the load, a load release mechanism for releasing the load from the load carrier and a floatation device coupled to the load carrier and the tool being configured to float relative to a liquid in the wellbore after the load is released.

10. The method of claim 9 further comprising autonomously operating the load release mechanism to release the load at a position in the wellbore before retrieving the tool from the wellbore.

11. The method of claim 8 wherein the tool comprises: (a) a liquid container tube configured to carry the resin, (b) a mechanical trigger mechanism configured to (i) sense when the tool has landed against a plug in the wellbore and (ii) break open the liquid container and (c) a floatation device coupled to an upper end of the liquid container and configured to render the tool buoyant relative to a liquid in the wellbore after the resin is released from the liquid container.

* * * * *